US007234377B2

(12) United States Patent
Wolfson

(10) Patent No.: US 7,234,377 B2
(45) Date of Patent: Jun. 26, 2007

(54) HAND TOOL

(75) Inventor: Ivan A. Wolfson, 149 Oak Knoll Ter., Highland Park, IL (US) 60035

(73) Assignee: Ivan A. Wolfson, Highland Park, IL (US)

( * ) Notice: Subject to any disclaimer, the term of this patent is extended or adjusted under 35 U.S.C. 154(b) by 6 days.

(21) Appl. No.: 11/223,075

(22) Filed: Sep. 9, 2005

(65) Prior Publication Data

US 2007/0056412 A1 Mar. 15, 2007

(51) Int. Cl.
*B25B 7/02* (2006.01)
*B25B 23/16* (2006.01)
*B25B 13/28* (2006.01)

(52) U.S. Cl. ..... 81/415; 81/418

(58) Field of Classification Search ..... 81/415, 81/421, 424.5, 426, 427.5, 418, 419
See application file for complete search history.

(56) References Cited

U.S. PATENT DOCUMENTS

| | | | | | |
|---|---|---|---|---|---|
| 321,133 | A | | 6/1885 | Osborne | |
| 331,812 | A | | 12/1885 | Norris | |
| 1,461,270 | A | * | 7/1923 | Garrison | 81/427.5 |
| 2,359,083 | A | | 9/1944 | Carlson | |
| 2,488,484 | A | | 11/1949 | Vander Clute | |
| 3,161,085 | A | * | 12/1964 | Pratt | 81/3.8 |
| 3,215,010 | A | | 11/1965 | Montgomery et al. | |
| 3,282,137 | A | * | 11/1966 | Lovelace | 81/302 |
| 3,869,793 | A | * | 3/1975 | Ferguson | 30/262 |
| 3,874,578 | A | * | 4/1975 | Derr et al. | 227/144 |
| 4,023,450 | A | * | 5/1977 | Ygfors | 81/418 |
| 4,124,929 | A | * | 11/1978 | Roux | 29/268 |
| 4,135,416 | A | | 1/1979 | Roux | |
| 4,526,172 | A | * | 7/1985 | Stephenson | 606/208 |
| 4,583,671 | A | * | 4/1986 | Cressy | 227/144 |
| 5,121,662 | A | * | 6/1992 | Wright | 81/427.5 |
| 5,662,665 | A | * | 9/1997 | Ludwick | 606/147 |
| 5,740,586 | A | * | 4/1998 | Gomas | 16/436 |
| 5,810,881 | A | | 9/1998 | Hoskin et al. | |
| 5,839,141 | A | * | 11/1998 | Hermann | 7/106 |
| 5,850,649 | A | * | 12/1998 | Simpson | 7/106 |
| 5,862,552 | A | | 1/1999 | Koelewyn | |
| 5,893,307 | A | * | 4/1999 | Tao | 81/427 |
| 6,339,980 | B1 | * | 1/2002 | Woolf | 81/185.1 |
| 6,530,099 | B1 | * | 3/2003 | Iwinski | 7/133 |
| 6,966,244 | B2 | * | 11/2005 | Herbst et al. | 81/418 |

FOREIGN PATENT DOCUMENTS

| | | |
|---|---|---|
| GB | 1929 | 6/1910 |

* cited by examiner

*Primary Examiner*—David B. Thomas
(74) *Attorney, Agent, or Firm*—Joseph A. Yosick; Brinks Hofer Gilson & Lione

(57) ABSTRACT

A hand tool includes a first arm and a second arm. The first arm includes a gripping portion and a handle. The gripping portion comprises a first gripping surface. The second arm includes a gripping portion and a handle. The gripping portion includes a second gripping surface opposed to the first gripping surface. The second arm is pivotally connected to the first arm. The hand tool is adapted to hold an object between the first and second gripping surfaces. The handle of the first arm is compliant such that it flexes with respect to the gripping portion in response to an applied force.

25 Claims, 7 Drawing Sheets

HAND TOOL

BACKGROUND

The present invention relates to a handle tool, and in particular, to a non-scratching hand tool.

Hand tools are used for variety of purposes to grasp objects such as bolts, nuts, and other fittings. However, some of these fittings are rather fragile and subject to scratching and other damage. Existing tools can put too much force on the fitting and damage it. Also, the metal gripping surface of existing tools can scratch a fitting. High-end fittings (including those with finishes such as lacquer, porcelain, and glass) can be especially vulnerable to damage. Damage to fitting is even more likely when the user is a homeowner or other amateur who does not have experience in using the tool.

SUMMARY

In one aspect, a hand tool includes a first arm and a second arm. The first arm includes a gripping portion and a handle. The gripping portion comprises a first gripping surface. The second arm includes a gripping portion and a handle. The gripping portion includes a second gripping surface opposed to the first gripping surface. The second arm is pivotally connected to the first arm. The hand tool is adapted to hold an object between the first and second gripping surfaces. The handle of the first arm is compliant such that it flexes with respect to the gripping portion in response to an applied force.

In another aspect, the hand tool is made of a non-conductive material such as plastic or rubber.

In another aspect, a tool and fitting system includes a tool with at least one gripping surface for gripping a fitting, and a fitting. The gripping surface includes a projecting member or an aperture, and the fitting comprises the other of a projecting member and an aperture. The projecting member and the aperture have complementary shapes such that the aperture is adapted to receive the projecting member, thereby securing the fitting to the gripping surface.

The foregoing paragraphs have been provided by way of general introduction, and are not intended to limit the scope of the following claims. The presently preferred embodiments, together with further advantages, will be best understood by reference to the following detailed description taken in conjunction with the accompanying drawings.

DETAILED DESCRIPTION

Figure 1:
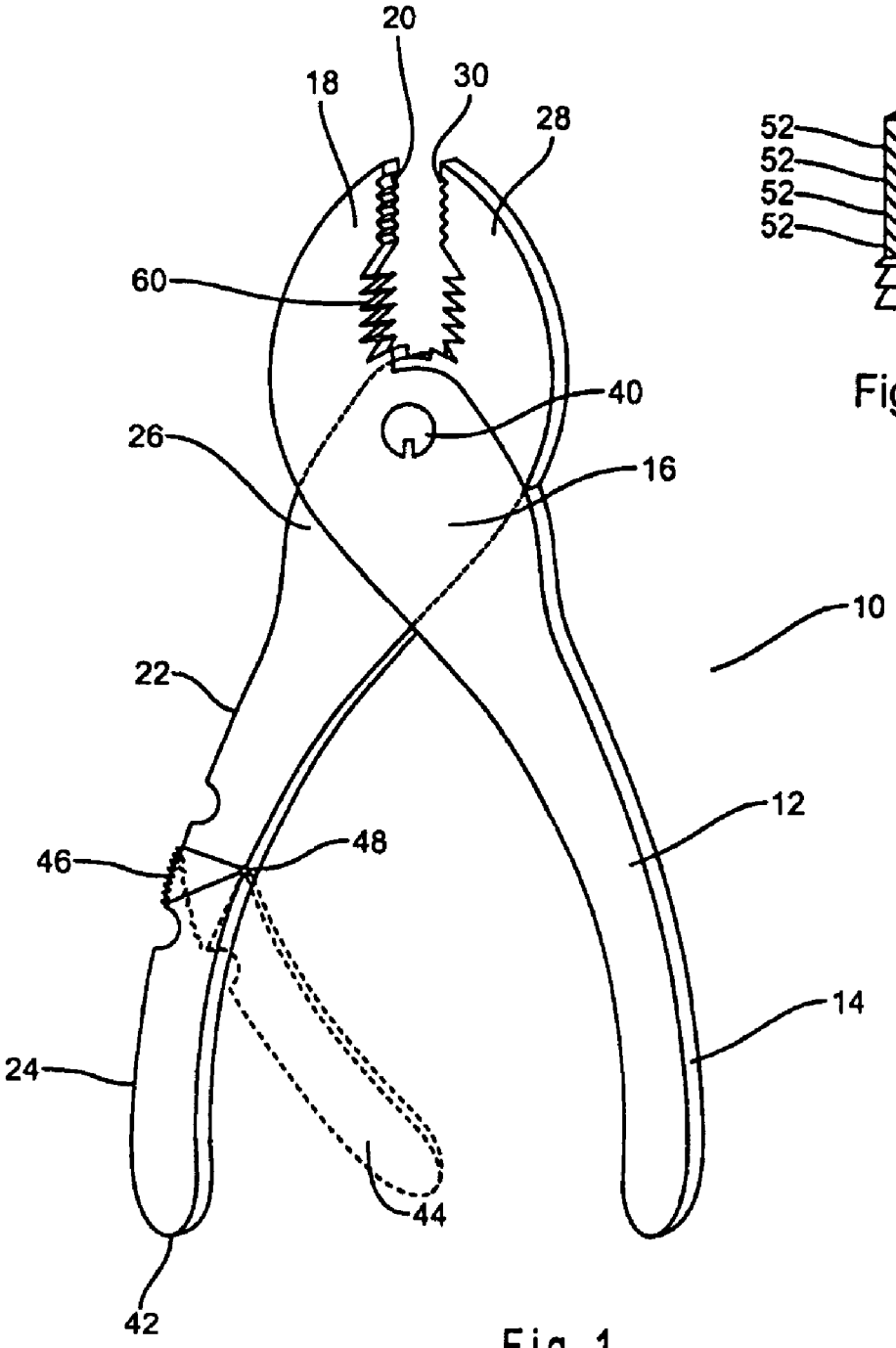
FIG. 1 shows one embodiment of a hand tool.

The invention is described with reference to the drawings in which like elements are referred to by like numerals. The relationship and functioning of the various elements of this invention are better understood by the following detailed description. However, the embodiments of this invention as described below are by way of example only, and the invention is not limited to the embodiments illustrated in the drawings.

The invention relates to a hand tool. Although certain embodiments of hand tools are disclosed, the term hand tool is meant to include any tool that fits in the hand of a user and is used to move another object, and includes, but is not limited to, pliers, wrenches, screw drivers, tweezers, forceps, and clamps. The term fitting is meant to include any object suitable for gripping by a hand tool, and includes, but is not limited to, washers, nuts, screws, bolts, pins, rivets, couplings, and lugs.

A first embodiment of a hand tool 10 is shown in FIG. 1. The hand tool 10, such as a pair of pliers, may include a first arm 12 and a second arm 22. The first arm 12 and second arm 22 are pivotally connected. Each arm includes a gripping portion 18, 28, a pivot portion 16, 26, and a handle 14, 24. The pivot portions 16, 26 of the two arms 12, 22 are pivotally connected, for example by a pivot pin 40. Each gripping portion 18, 28 includes a gripping surface 20, 30. The gripping surfaces 20, 30 are generally opposed to each other. The gripping surfaces 20, 30 are adapted to hold an object between them, such as a fastener. The handles 14, 24 are separated by a distance that allows a user to comfortably grasp the hand tool 10 in the user's hand. As the user squeezes the handles 14, 24 together, the gripping surfaces 20, 30 come together. The handles 12, 24 may include a textured or grooved surface to allow the user to have a better grip.

Turning now to the handles 14, 24 of the tool 10, the handle 24 of one of the arms 22 is compliant such that it flexes with respect to the gripping portion 28 in response to an applied force. Thus, if the user presses too hard on the handles 14, 24, the handle 24 will flex to prevent too much force being applied to the object being held in the grip. The arm 24 will flex from a first position 42 to a second position 44, as shown in FIG. 1. This helps to prevent a delicate object from being scratched or otherwise damaged by the gripping surfaces 20, 30. In one embodiment, the arm 22 does not flex until a predetermined force level is applied. The amount of desired flex depends on the size of the object being grasped and how fragile or prone to scratching the object is.

Figure 2:
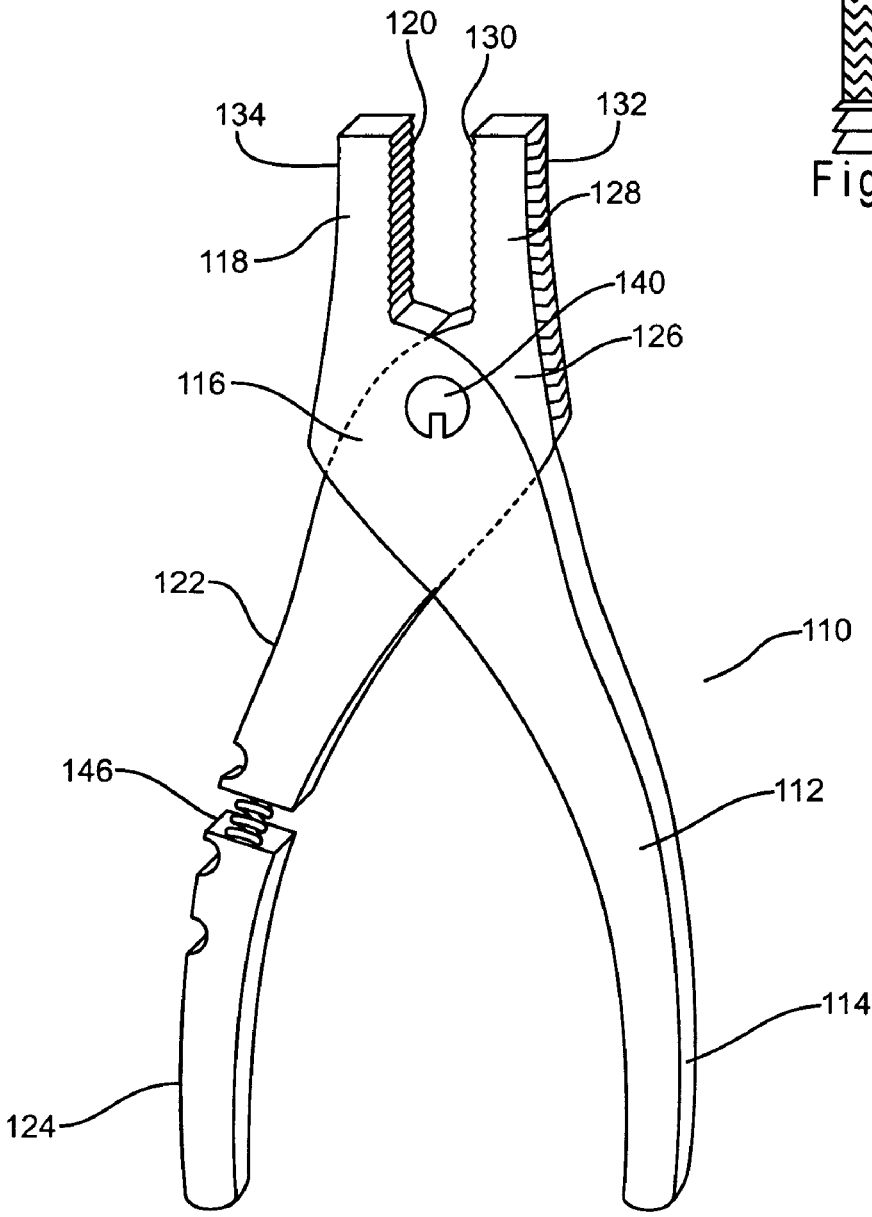
FIG. 2 shows a second embodiment of a hand tool.

A second embodiment of a hand tool 110 is shown in FIG. 2. The hand tool 110 includes a first arm 112 and a second arm 122. Each arm 112, 122 includes a gripping portion 118, 128, a pivot portion 116, 126, and a handle 114, 124. The arms 112, 122 may also include exterior gripping surfaces 132, 134, which may be used for prying something open, for example. The handle 124 of the first arm 122 includes a spring portion 146 that allows the handle 122 to flex. The first arm 122 includes a pivot portion 126 between the handle 122 and the gripping portion 128, wherein the pivot portion 126 is connected to the handle 122 by a spring 146. The stiffness of the spring 146 determines the amount of force applied to the object being gripped. The spring 146 may be integrally formed in the handle 122, or attached to the handle 122 by any suitable method.

In addition to a spring 46, a hinge 48 may attach the handle 24 to the pivot portion 26, as shown in FIG. 1. The hinge 48 may be integrally formed in the handle 24 or attached to the handle 24 and pivot portion 26 by any suitable method. The hinge 48 may allow a more secure connection between the handle 22 and the pivot portion 26 than just a spring 46 alone. Although the embodiments shown in FIGS. 1 and 2 show the spring 46, 146 in just one handle 24, 124, the spring 46, 146 may be in both handles as well. The spring 46, 146 may be exposed or hidden from the view of a user.

The tension in the handle 124 may be adjustable by the user. This may be accomplished by a variety of methods. For example, as shown in one embodiment in FIG. 2A, the length of the spring 146 between the handle 124 and the pivot portion 126 is adjustable, which may be used to adjust the tension in the spring 146. The handle 124 includes a cavity 156 adapted to hold the spring 146, with a set screw 150 running through the handle 124 into the cavity 156. By pressing the spring 146 into the cavity 156 and tightening the set screw 150, the set screw 150 holds the spring 146 in place, resting between adjacent spirals 152, 154 of the spring 146. By adjusting the length of spring 146 which extends between handle 124 and pivot portion 126, the amount of resistance necessary for the handle 124 to flex may be adjusted.

The gripping portion 18, 28 and gripping surfaces 20, 30 in each arm 12, 22 may be the same or different, depending on the desired application and the object desired to be gripped. Thus, in one embodiment shown in FIG. 2, both the gripping surfaces 120, 130 are generally flat. In another embodiment shown in FIG. 1, one or both gripping surfaces 20, 30 include a concave portion 60, in order to accommodate a generally circular fastener or fitting therebetween. In another embodiment (not shown), one gripping surface is concave and the other is convex. The shapes of the gripping surfaces may depend on the intended use of the tool and the shape of the fitting. The gripping surfaces may also be either integrally formed with the arms, or connected as a separate piece. For example, the gripping surface may be formed as a plastic or rubber piece that is then attached to the respective handles of the tool. Alternatively, the gripping surface may be a plastic or rubber piece that slides onto the end of the arm. Thus, the tool may include various changeable gripping surfaces of different softness/firmness and/or texture, wherein the user can select the appropriate gripping surface for the intended application.

Figure 1A:
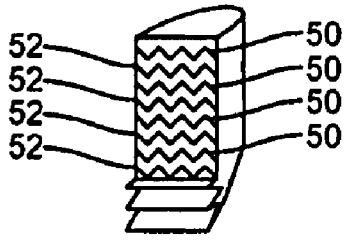
FIG. 1A shows the gripping surface of the hand tool of FIG. 1.
Figure 2B:
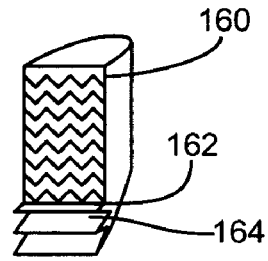
FIG. 2B shows the interior gripping surface of the hand tool of FIG. 2.
Figure 2C:
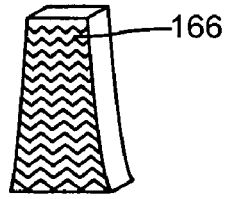
FIG. 2C shows the exterior gripping surface of the hand tool of FIG. 2.
Figure 2A:
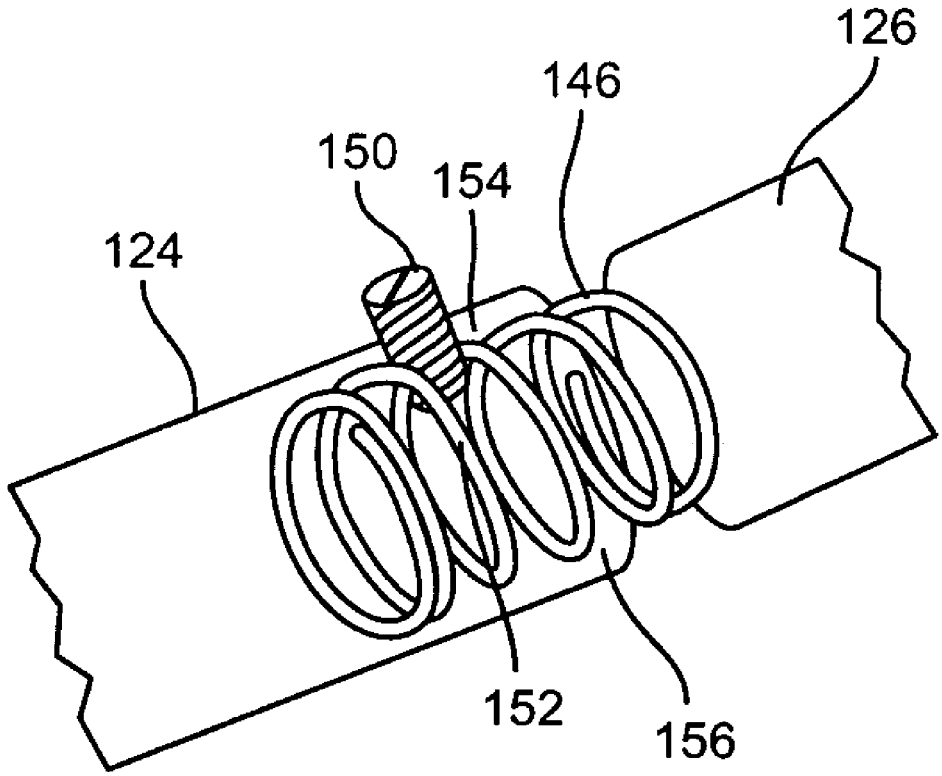
FIG. 2A is a partial enlarged view of the handle of the hand tool of FIG. 2.
Figure 2D:
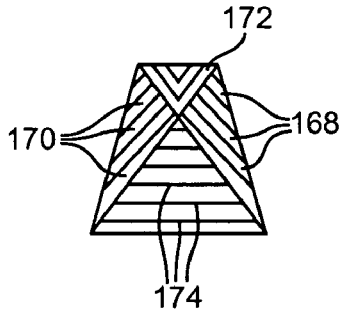
FIG. 2D shows an alternative gripping surface of the hand tool of FIG. 2.
Figure 2E:
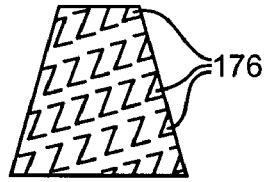
FIG. 2E shows an alternative gripping surface of the hand tool of FIG. 2.
Figure 2F:
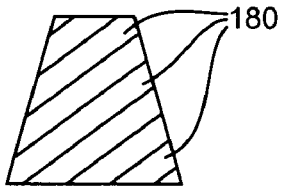
FIG. 2F shows an alternative gripping surface of the hand tool of FIG. 2.
Figure 2G:
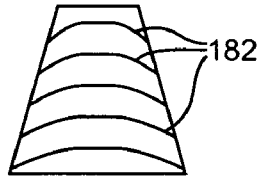
FIG. 2G shows an alternative gripping surface of the hand tool of FIG. 2.
Figure 2H:
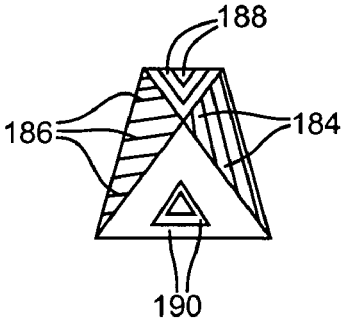
FIG. 2H shows an alternative gripping surface of the hand tool of FIG. 2.
Figure 2I:
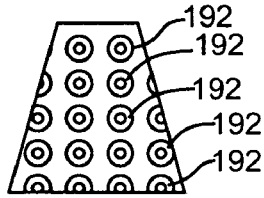
FIG. 2I shows an alternative gripping surface of the hand tool of FIG. 2.

The pattern of the gripping surfaces 20, 30 may influence the ease with which a fitting may be grasped by the tool and how likely the fitting is to be scratched by the tool. In one embodiment, the gripping surfaces 20, 30 include a pattern of alternating shallow grooves 52 and deep grooves 50, as shown in FIG. 1A. Other patterns are possible. Examples of other gripping patterns are shown in FIGS. 2B-2I. FIG. 2B shows a gripping surface with zig-zagging ridges 160 on one portion, and projecting ridges 162 and valleys 164 on another portion. FIG. 2C shows a gripping surface with zig-zagging ridges 166. FIG. 2D shows a gripping surface with parallel slanted ridges 168, 170, V-shaped ridges 172, and parallel straight ridges 174. FIG. 2E shows a gripping surface with Z-shaped ridges 176. FIG. 2F shows a gripping surface with parallel slanted ridges 180. FIG. 2G shows a gripping surface with arcuate ridges 182. FIG. 2H shows a gripping surface with parallel horizontal ridges 186, parallel vertical ridges 184, and triangular ridges 188, 190. FIG. 2I shows a gripping surface with circular ridges 192. Variations and combinations of these gripping surfaces are possible.

The hand tool may be made of any suitable material such as durable plastic, or coated metal. The hand tool may be made of an electrically insulating or non-conductive material in order to protect the used against electrical shock. Suitable materials include rubber, nylon, polycarbonate, fluorinated polymers, ABS, polypropylene, and polyester. Alternatively, the hand tool may be made of metal and coated with a plastic or rubber material. The gripping surfaces are preferably made from a non-scratching and non-conductive material.

The hand tool 10 may be used as follows. The user grasps the handles 14, 24 of the tool 10 in his hands. A fitting is placed between the gripping surfaces 20, 30 of the hand tool 10. The user then applies force to the handles 14, 24, which in turns applied a force between each of the gripping surfaces 20, 30 and the fitting therebetween. If the user applies too much force, the handle 24 will flex to prevent too much force form being applied to the fitting.

Figure 3A:
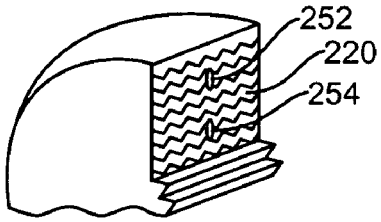
FIG. 3A shows the gripping surface of the hand tool of FIG. 3 with retracted pins.
Figure 3B:
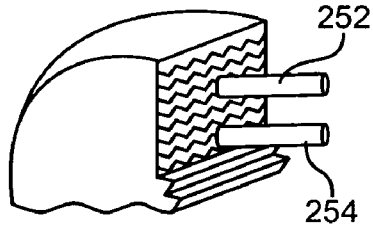
FIG. 3B shows the gripping surface of the hand tool of FIG. 3 with extended pins.
Figure 3:
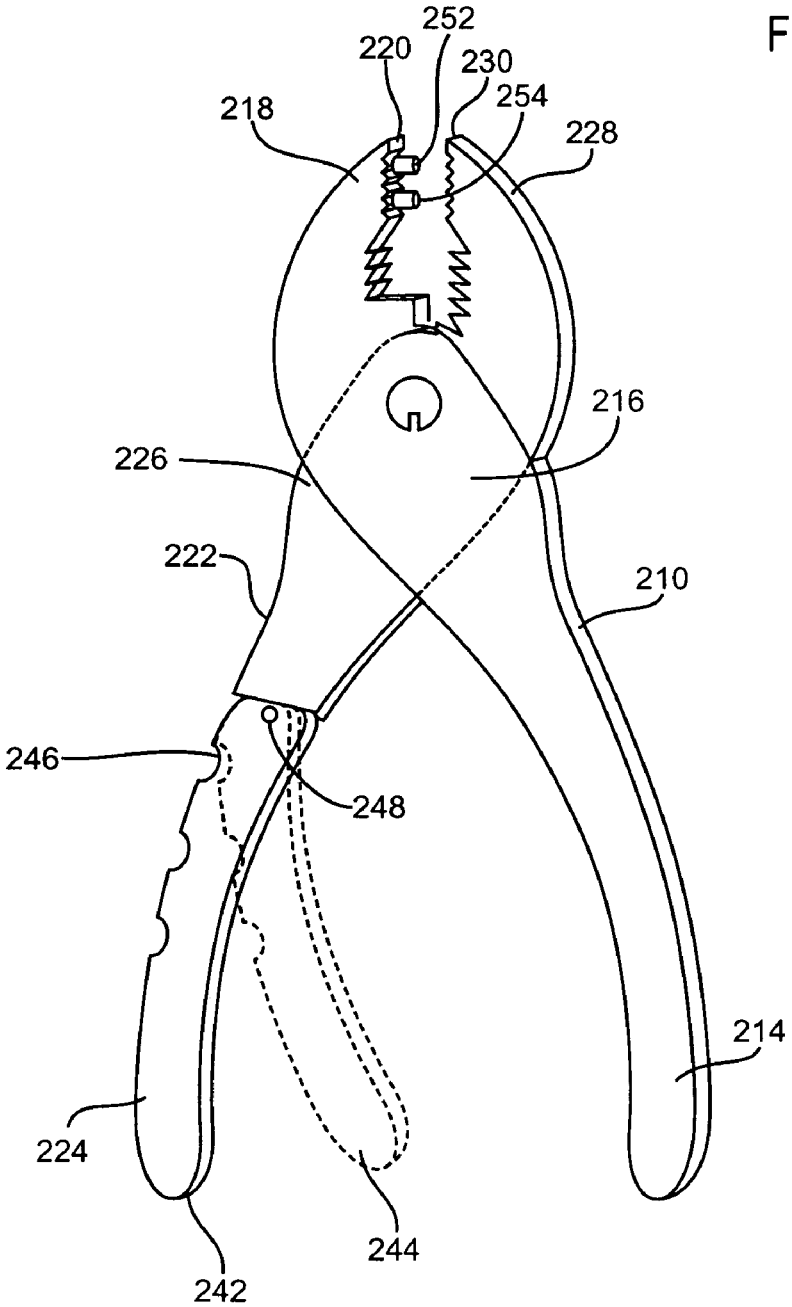
FIG. 3 shows a third embodiment of a hand tool.
Figure 4:
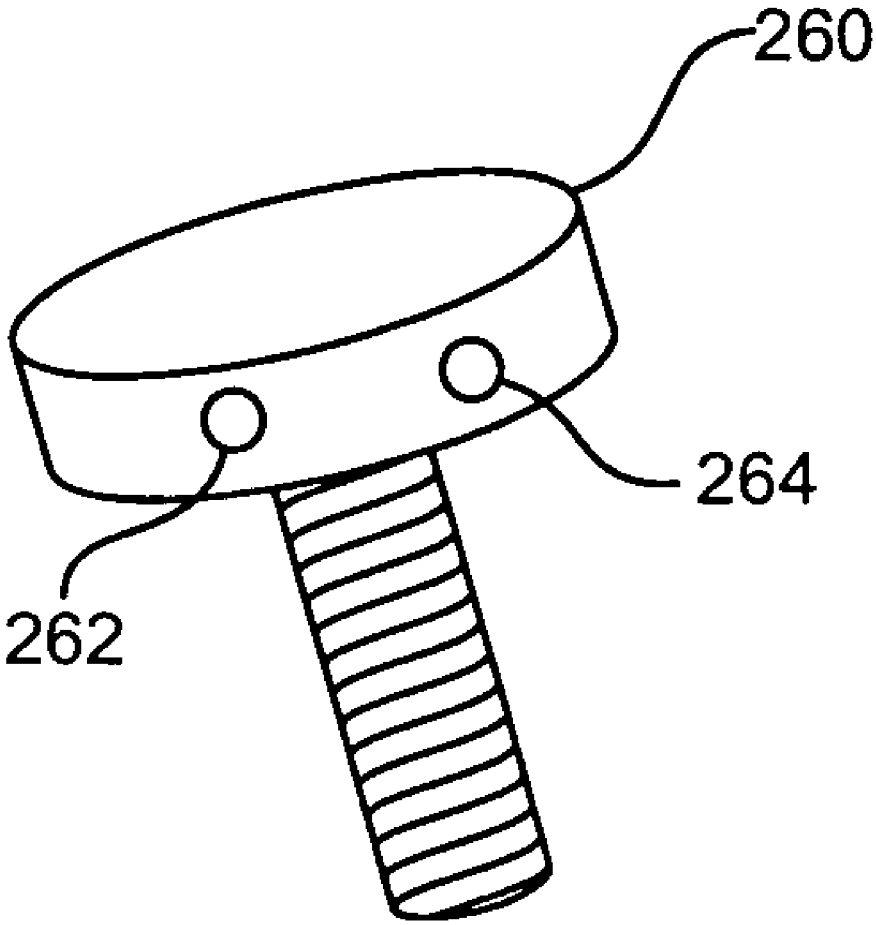
FIG. 4 shows an embodiment of a fitting adapted to be used with the hand tool of FIG. 3.

An embodiment of a tool and fastener system is shown in FIGS. 3 and 4. The tool 210 includes a gripping portion 218 with at least one gripping surface 220 for gripping a fitting. In general the gripping portion 218 includes either a projecting member or an aperture, and the fastener includes the other of a projecting member and an aperture. The tool 210 in FIG. 3 includes two projecting members or pins 252, 254. FIG. 4 shows an embodiment of a fastener 260 with two apertures 262, 264 corresponding to the pins 252, 254 of hand tool 210. The projecting members 252, 254 and the apertures 262, 264 have complementary shapes such that the apertures 262, 264 are adapted to receive the projecting members 252, 254, thereby releasably securing the fastener 260 to the gripping surface 220. The gripping portion 218 includes a gripping surface 220 made from a non-scratching material. The non-scratching material includes materials such as plastic, nylon, or rubber.

The gripping portion may include one or more projecting pins and the fastener includes one or more holes adapted to receive the projecting pins. The gripping portion may include one or more projecting ridges and the fitting includes one or more channels adapted to receive the projecting ridges. The fitting may include a projecting member and the gripping surface may include an aperture, or that both the fitting and the gripping surface may include a mixture of complementary projecting members and apertures.

As shown in FIGS. 3A and 3B, the projecting members 252, 254 in the gripping portion 218 may be retractable. Thus, in one position as shown in FIG. 3B, the projecting members 252, 254 are extended in order to be used with a fitting. The projecting members 252, 254 may then be retracted, as shown in FIG. 3A, when the tool 210 is used for other types of fittings.

The tool and fitting system can be used with a wide variety of tools. The shape and configurations of the projecting member and the apertures will depend on the type of tool and fitting system. In one embodiment, as shown in FIGS. 3 and 4, the tool 210 is a pair of pliers and the fitting 260 is a washer, a nut, or similar fitting. The tool in the tool and fitting system can also be any of the previously described embodiments including those shown in FIGS. 1 and 2. The gripping surfaces 20, 30, 120, 130, 220, 230 of the tools 10, 110, 210 shown in FIGS. 1-3 may also be used with any of the tools 10, 110, 210 shown in FIGS. 1-3.

Figure 5:
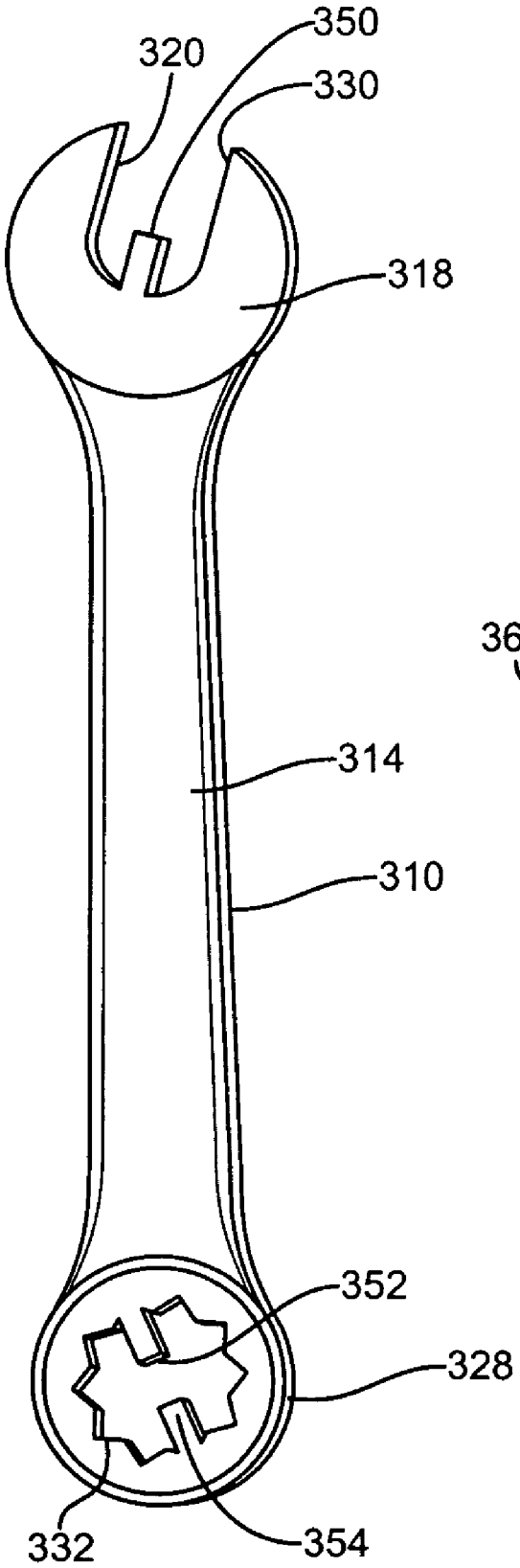
FIG. 5 shows a fourth embodiment of a hand tool.
Figure 6:
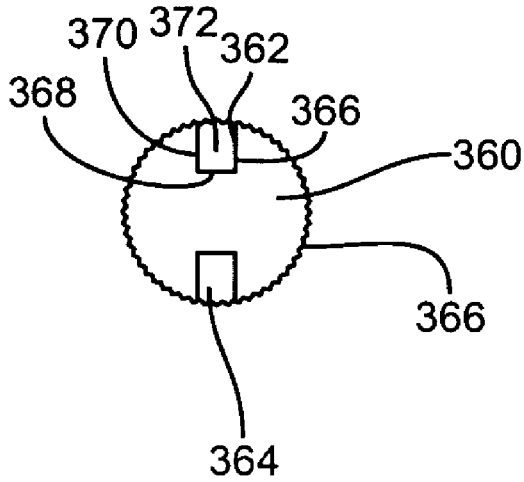
FIG. 6 is a top view of an embodiment of a fitting adapted to be used with the hand tool of FIG. 5.

In another embodiment, as shown in FIG. 5, the tool is a wrench 310 and the fitting 360 is a washer, nut, bolt, pin, rivet, screw, or coupling. The wrench 310 includes a handle 314 and gripping portions 318 and 328. Gripping portion 318 includes two generally parallel gripping surfaces 320, 340 and a projecting member 350. Gripping portion 328 includes gripping surface 332 and projecting members 352, 354. FIG. 6 shows the top of an embodiment of a bolt 360 with an outer surface 366 that corresponds to the gripping surfaces 320, 330 and 332 of wrench 310. Bolt 360 includes apertures 362, 364 that correspond to projecting members 352 and 354 of gripping portion 328 and projecting member 350 of gripping portion 318. Aperture 262 is defined by side surfaces 366, 368, and 370 and bottom surface 372, with the top being open. Either end of wrench 310 may be used to grip bolt 360. Of course, other combinations of tools and fittings are possible and are intended to be encompassed.

The shape and configurations of the projecting member and the apertures will depend on the type of tool and fitting system. For example, for a fitting that needs to be very tight, it may be preferred that the gripping surface have relatively long, pin-like projecting members and the fitting have deep hole-like apertures in order to provide a solid grip for tightening. In contrast, for a more ornamental application, such as a decorative nut, the gripping surface may have a relatively short projecting ridge, and the head of a nut have a relatively shallow channel, in order for the tool to adequately grip the fitting and prevent from scratching it. The apertures may include a single opening and a hole defined by surfaces on all sides (such as holes 262, 264 in FIG. 4). The apertures may also be channels with an open side (such as apertures 262, 264 in FIG. 6). Other combinations of complementary projecting members and apertures are possible.

The gripping surfaces 220, 230, 320, 330, and 332 of the tool may be non-scratching and made of a soft or compliant material. Because the projecting member of the tool serves as the primary interaction with the fitting, the gripping surface does not need to provide as much grip as it would otherwise have to. Thus, the gripping surface may be a soft rubber or plastic or other suitable material. This further prevents scratching of the fitting.

The tool and fitting system may be used as follows. The user grasps the handles of the tool in his hands. A fitting is placed between the gripping surfaces of the hand tool. The projecting member and aperture are then connected in order to hold the fitting against the gripping surface. For example, for the system shown in FIGS. 3 and 4, the apertures 262, 264 in the fitting 260 are oriented with the pins 252, 254 of the tool 210, and the pins 252, 254 are inserted into the apertures 262, 264. The handles 214, 224 are then tightened to secure the fastener 260 between the gripping surfaces 220, 230. The tool 210 may then be used to secure the fastener 260 to another object, while minimizing the likelihood of scratching the fastener 260.

For the system shown in FIGS. 5 and 6, the aperture 362 or 364 in the fitting 360 is oriented with the pin 350 on the gripping portion 318 of the wrench 310, and the pin 350 is inserted into the aperture 362 or 364. Alternatively, apertures 362 and 364 in the fitting 360 are oriented with the pins 352, 354 and gripping surface 332 on the gripping portion 328, and the pins 352, 354 are inserted into apertures 362 and 364. The wrench 310 is then used to secure the fastener 360 to another object, while minimizing the likelihood of scratching the fastener.

The embodiments described above and shown herein are illustrative and not restrictive. The scope of the invention is indicated by the claims rather than by the foregoing description and attached drawings. The invention may be embodied in other specific forms without departing from the spirit of the invention. Accordingly, these and any other changes which come within the scope of the claims are intended to be embraced therein.

What is claimed is:

1. A hand tool comprising:

a first arm comprising a gripping portion and a handle, wherein the gripping portion comprises a first gripping surface and the handle comprises a distal end and a pivot portion; and a second arm comprising a gripping portion and a handle, wherein the gripping portion comprises a second gripping surface opposed to the first gripping surface and wherein the second arm is pivotally connected to the first arm;

wherein the hand tool is adapted to hold an object between the first and second gripping surfaces, and wherein the handle of the first arm comprises a spring portion between the distal end and the pivot portion, such that the handle flexes with respect to the gripping portion in response to an applied force.

2. The hand tool of claim 1 wherein the handle of the first arm flexes with respect to the gripping portion in response to an applied force of a predetermined force level.

3. The hand tool of claim 2 wherein the predetermined force level is adjustable by a user.

4. The hand tool of claim 1 wherein the first and second arm are comprised at least in part of plastic.

5. The hand tool of claim 1 wherein the first and second arm comprise an electrically insulating material.

6. The hand tool of claim 1 wherein the first and second gripping surfaces each comprises a pattern of alternating shallow and deep grooves.

7. The hand tool of claim 1 wherein the first and second gripping surfaces comprise a gripping pattern and are made of a non-scratching and non-conductive material.

8. The hand tool of claim 7 first and second gripping surfaces comprise a plastic material.

9. The hand tool of claim 7 first and second gripping surfaces comprise a material selected from the group consisting of rubber, nylon, polycarbonate, fluorinated polymers, ABS, polypropylene, and polyester.

10. The hand tool of claim 7 wherein the gripping pattern comprises a pattern of alternating shallow and deep grooves.

11. The hand tool of claim 1 wherein the first and second gripping surfaces are each formed as a separate piece attached to the respective arm.

12. The hand tool of claim 11 wherein each gripping surface slides onto the respective arm.

13. The hand tool of claim 1 wherein the hand tool is coated with a rubber material.

14. A hand tool comprising:

a first arm comprising a gripping portion, a handle, and a pivot portion between the handle and the gripping portion, wherein the pivot portion is connected to the handle by a spring member, and wherein the gripping portion comprises a first gripping surface; and a second arm comprising a gripping portion and a handle, wherein the gripping portion comprises a second gripping surface opposed to the first gripping surface and wherein the second arm is pivotally connected to the first arm;

wherein the hand tool is adapted to hold an object between the first and second gripping surfaces, and wherein the handle of the first arm is compliant such that it flexes with respect to the gripping portion in response to an applied force.

15. The hand tool of claim 14 further comprising a hinge connecting the handle to the pivot portion.

16. A hand tool comprising:

at least one gripping portion comprising:

a gripping surface made from a non-scratching material; and one of a projecting member and an aperture, wherein the gripping surface is adapted to grip a fitting comprising the other of a projecting member and an aperture, the projecting member and the aperture having complementary shapes such that the aperture is adapted to receive the projecting member, thereby releasably securing the fitting to the gripping surface.

17. The hand tool of claim 16 wherein the gripping member comprises one or more projecting pins.

18. The hand tool of claim 16 wherein the gripping member comprises one or more projecting ridges.

19. The hand tool of claim 16 wherein the gripping surface comprises a gripping pattern and is made of a plastic or rubber material.

20. The hand tool of claim 16 wherein the tool is a wrench.

21. A hand tool comprising:

a first arm comprising a gripping portion and a handle, wherein the gripping portion comprises a first gripping surface and the handle comprises a distal end and a pivot portion; and a second arm comprising a gripping portion and a handle, wherein the gripping portion comprises a second gripping surface opposed to the first gripping surface and wherein the second arm is pivotally connected to the first arm;

wherein the handle of the first arm comprises a spring portion between the distal end and the pivot portion, such that the handle flexes with respect to the gripping portion in response to an applied force; and wherein the gripping portion of the first arm comprises one of a projecting member and an aperture, and the gripping surface of the first arm is adapted to engage a fitting comprising the other of a projecting member and an aperture, the projecting member and the aperture having complementary shapes such that the aperture is adapted to receive the projecting member, thereby releasably securing the fitting to the gripping surface of the first arm.

22. The hand tool of claim 21 wherein the gripping surface comprises a gripping pattern and is made of a plastic or rubber material.

23. The hand tool of claim 21 wherein the spring portion comprises a spring member.

24. The hand tool of claim 23 wherein the tension of the spring member is adjustable.

25. The hand tool of claim 23 further comprising a hinge connecting the handle to the pivot portion.

* * * * *